United States Patent [19]

McConnell

[11] Patent Number: 4,579,324

[45] Date of Patent: Apr. 1, 1986

[54] UNIVERSAL EXTREMITY POSITIONER

[76] Inventor: Bernard E. McConnell, 512 1st Greenville National Bank Bldg., Greenville, Tex. 75401

[21] Appl. No.: 598,579

[22] Filed: Apr. 10, 1984

Related U.S. Application Data

[63] Continuation of Ser. No. 267,523, May 27, 1981, abandoned.

[51] Int. Cl.[4] ..... A61G 13/00

[52] U.S. Cl. ..... 269/328

[58] Field of Search ..... 269/328, 75, 77, 78, 269/79, 81, 71; 128/84; 248/288.5, 286, 279; 403/90, 59, 385

[56] References Cited

U.S. PATENT DOCUMENTS

| | | | |
|---|---|---|---|
| 1,397,453 | 11/1921 | Rekar | 403/59 |
| 1,625,682 | 4/1927 | Rugg | 269/328 |
| 1,968,120 | 7/1934 | Barghausen et al. | 269/328 |
| 2,287,874 | 6/1942 | Gibbons et al. | 403/59 |
| 2,340,572 | 2/1944 | Smith | 248/279 |
| 2,776,152 | 1/1957 | Ianuzzi | 403/90 |
| 2,861,501 | 11/1958 | Strelakos | 403/90 |
| 3,099,441 | 7/1963 | Ries | 269/328 |
| 3,381,684 | 5/1968 | Anderson | 269/328 |
| 3,389,702 | 6/1968 | Kennedy | 269/328 |
| 4,222,680 | 9/1980 | Browning | 403/90 |
| 4,342,451 | 8/1982 | Teague | 269/328 |

FOREIGN PATENT DOCUMENTS

| | | | |
|---|---|---|---|
| 823556 | 9/1969 | Canada | 269/328 |
| 1262696 | 4/1961 | France | 269/328 |

*Primary Examiner*—Robert C. Watson

*Attorney, Agent, or Firm*—Glaser, Griggs & Schwartz

[57] ABSTRACT

A positioning apparatus for use in surgical operating procedures and the like comprising one or more generally vertically extending support arms which are connected at their lower ends to universal positioner mechanisms which may be adjustably positioned along a support bar suspended from and substantially rigidly connected to an operating table or the like. The positioning mechanism includes a ball and socket coupling including spaced apart support block having socket portions for forcibly engaging the ball under the urging of a plurality of springs. A lever actuated cam connected to a foot pedal is operable to release the biasing force on the support blocks whereby the position of the support arm connected at one end to the ball may be finely adjusted over a wide range of positions. The positioning mechanism may also comprise clamping members adjustable about three mutually perpendicular axes to provide universal movement of a support arm.

13 Claims, 7 Drawing Figures

UNIVERSAL EXTREMITY POSITIONER

This is a continuation of application Ser. No. 06/267,523, filed 5/27/81, now abandoned.

BACKGROUND OF THE INVENTION

1. Field of the Invention

The present invention pertains to a positioning mechanism for supporting a patient while lying on an operating table or the like during the performance of surgery or other medical procedures.

2. Background Art

In the performance of orthopedic surgery and related medical procedures, it is often necessary to support a portion of the patient's body including one or more limbs in a particular position during the procedure, nd also to vary the position from time to time. In this regard, there has been a long felt need for apparatus which is capable of suspending a patient extremity, such as an arm or leg, for maintaining the extremity in a particular position in relation to the rest of the patient's body. Heretofore, known techniques include supporting the patient while lying on an operating table by using personnel participating in the procedure to manually support the particular extremity and to change the position of the extremity as desired. It is also known to use virtually any object including pillows or other padded objects on which the patient extremity is supported or biased. Since such objects often obstruct the performance of surgery or other procedures and are not easily moved from one position to another, such techniques have been generally unsatisfactory. Moreover, the use of personnel to support a patient during the performance of surgery or the like, is unsatisfactory in that the person supporting the patient may tire and find it necessary to change position in the midst of a delicate procedure.

Accordingly, it has been considered highly desirable to provide mechanism which may be supported by an operating table or the like and which is adapted to support and position various parts of a patient's body including the limbs during the performance of surgery on a portion of the limb itself or a connecting joint. There has also been a need for mechanism for positioning a patient limb or extremity which may be used to vary the position during surgery or treatment or to impose or change a biasing force on that portion of the patient's body which is undergoing the treatment.

There has also been a need in the art of surgical equipment for an apparatus which may be mounted on an operating table or the like and which is adapted to be moved with the table to any position thereof, which apparatus also includes structure disposed above the support surface of the table, in the sterile area, which can be easily removed from the remaining part of the apparatus for sterilization and which remains sterile during adjustment thereof.

The foregoing needs in the art of apparatus for supporting patients during the performance of surgery and other procedures have been satisfied by the present invention which provides other advantages and superior features that will be recognized by those skilled in the art.

SUMMARY OF THE INVENTION

The present invention provides a positioning apparatus for use in connection with an operating table or other support structure for supporting a patient during the performance of medical procedures, which apparatus is adapted to be easily adjusted to a wide range of positions of the patient or an extremity.

The present invention also provides an apparatus which is particularly adapted for being removably mounted on standard surgical operating tables for supporting one or more parts of the patient's body during the performance of surgery and the like. In particular, the apparatus of the present invention includes one or more support arms which are adjustably mounted on supporting structure mounted below the patient support surface of an operating table, which arms may be substantially universally adjusted to a wide range of positions and secured in a predetermined position for supporting a patient extremity and for tensioning or biasing a portion of the patient or his extremities as required during their performance of a particular medical procedure.

In accordance with one important aspect of the present invention, a universal positioning mechanism is provided for positioning a support arm for supporting a patient, and particularly, an extremity during surgery thereon, which mechanism may be adjusted while in use by the surgeon and wherein the surgeon's hands may remain free for performing the procedure or other tasks while the position of the support arm is being altered.

In accordance with another important aspect of the present invention two embodiments of a universal positioning mechanism are disclosed which are particularly adapted for mounting on an elongated support bar mounted below the patient support surface of an operating table or the like and wherein a plurality of positioning mechanisms may be provided, each supporting a positioning arm and associated extremity support structure.

The present invention still further provides an improved positioning apparatus for supporting a patient extremity during the performance of a medical procedure or the like wherein portions of the apparatus disposed in the sterile zone in which the procedure is being performed may be easily removed from the remaining structure of the positioning mechanism for sterilization purposes. Moreover, the removable sections of the positioning mechanism support arms are adjustable and always remain exposed only to the sterile zone.

The superior features and advantages of the present invention will be further appreciated by those skilled in the art upon reading the detailed description which follows in conjunction with the drawings.

DESCRIPTION OF THE PREFERRED EMBODIMENTS

Figure 1:
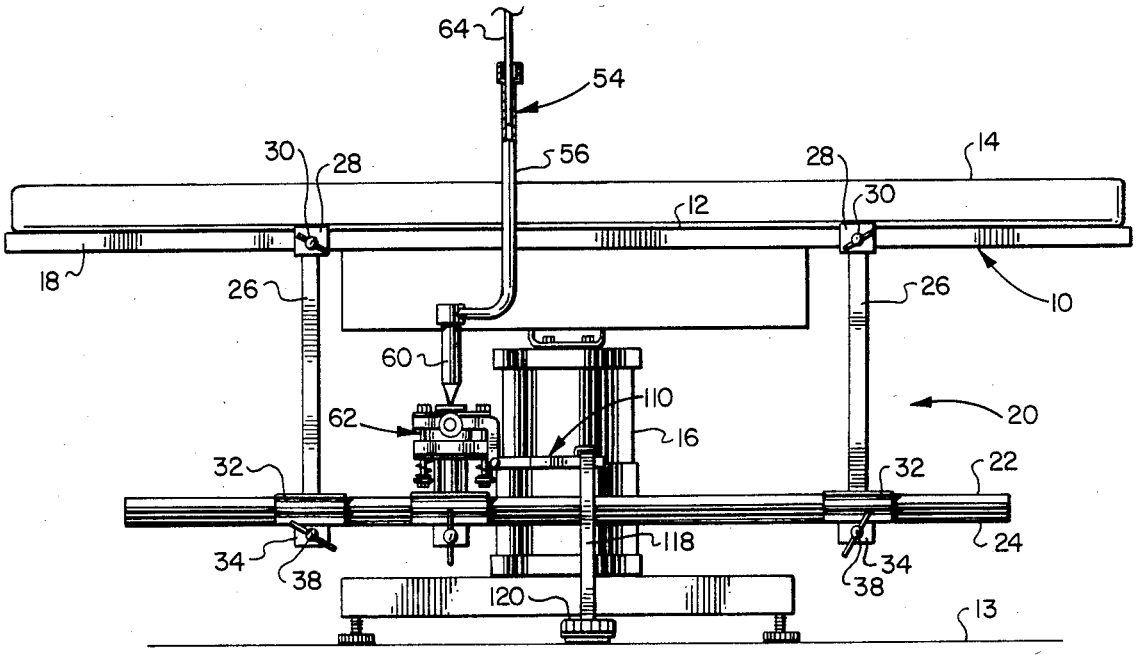
FIG. 1 is a longitudinal side elevation of the positioning apparatus of the present invention mounted on a surgical operating table.

In the description which follows, like parts are indicated throughout the specification and drawings with the same reference numerals, respectively. The drawings are not necessarily to scale and certain parts have been exaggerated to better illustrate details of the present invention.

Figure 2:
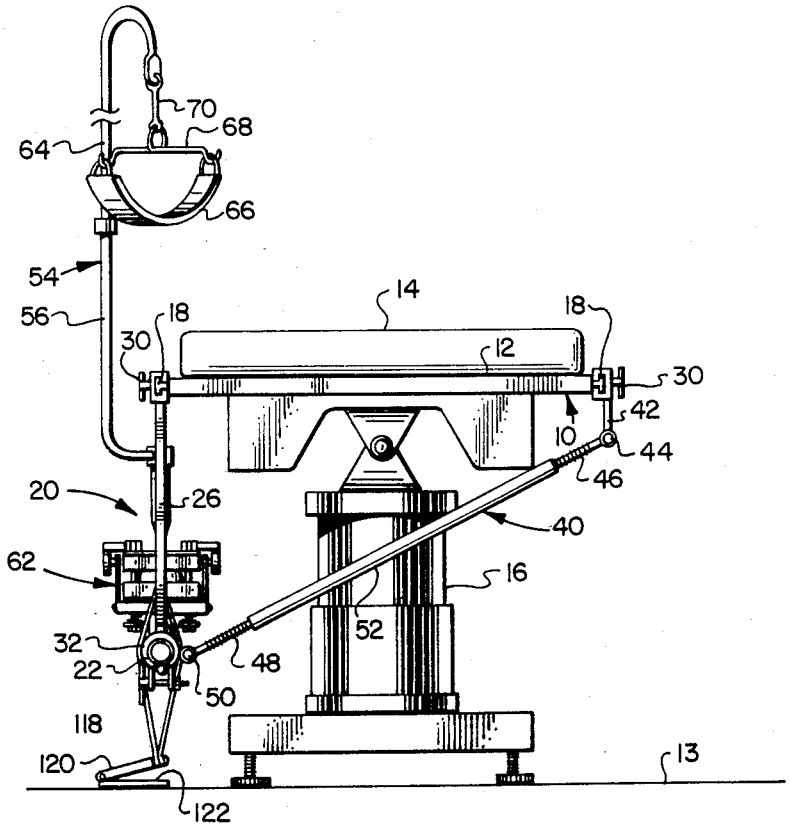
FIG. 2 is an end elevation of the apparatus mounted on the table as shown in FIG. 1.

The extremity positioning mechanism of the present invention is particularly adapted for use in connection with a conventional surgical operating table which may be varied in position itself as required during the performance of surgery or other medical procedures. Referring to FIGS. 1 and 2 of the drawings, there is illustrated an operating table generally designated by the numeral 10 which includes a patient support surface 12 and a sterile pad 14. The table 10 includes a base structure 16 which is adapted to provide for altering the position of the patient support surface 12 out of the generally horizontal position shown in the drawing figures, for example. The table 10 also includes, along opposite longitudinal sides thereof, longitudinal support rails 18 which may be of conventional design. The rails are characterized as somewhat elongated flat metal bars having spaced apart support members or flange portions for attachment to the table.

Figure 3:
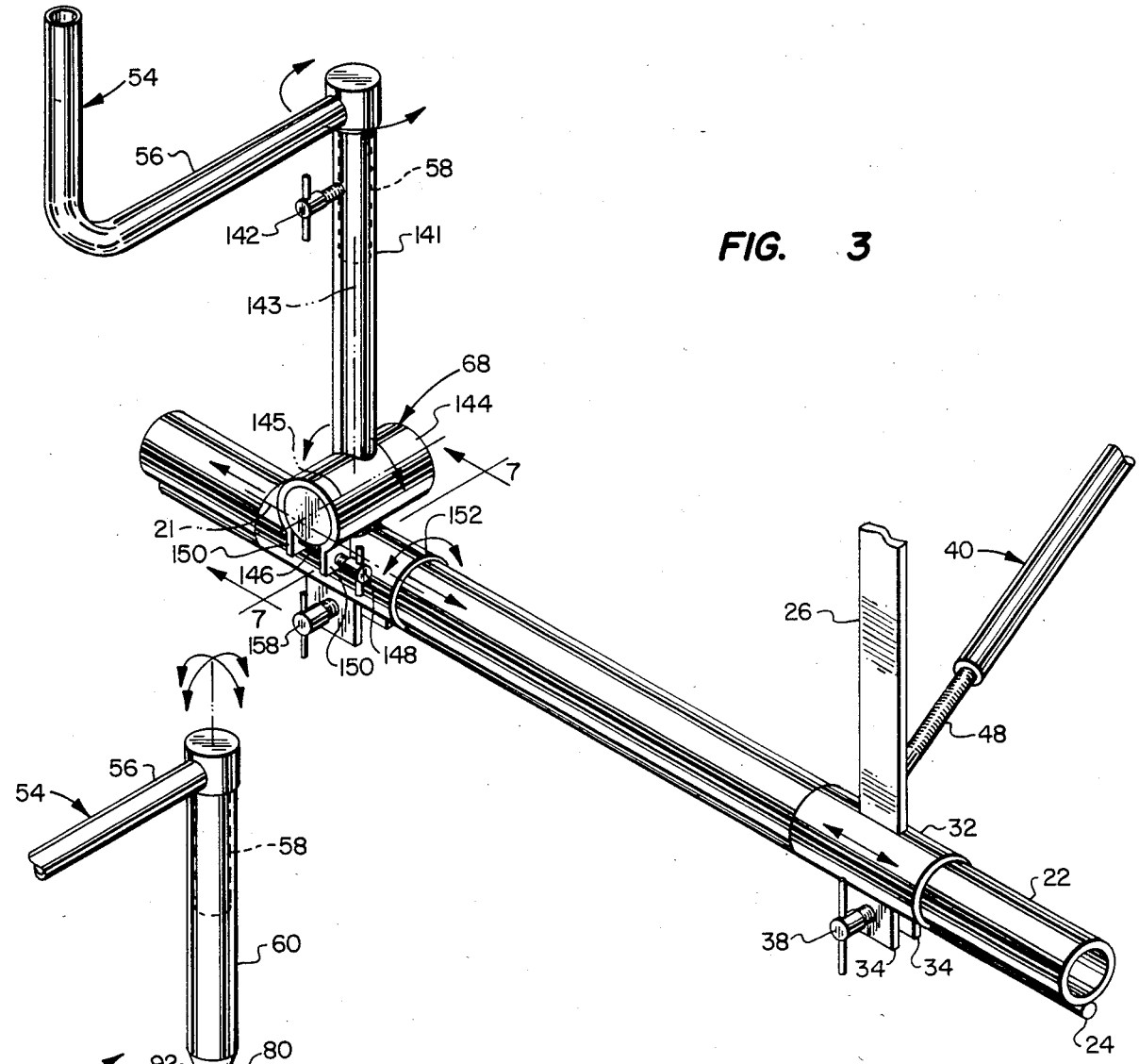
FIG. 3 is a perspective view of one embodiment of a positioning mechanism in accordance with the present invention.

FIGS. 1 and 2 illustrate an improved apparatus providing for the positioning of a patient, not shown, when the patient is lying on the table 10 during the performance of surgery or other medical procedures. The improved apparatus of the present invention is generally designated by the numeral 20 and includes a frame or support structure including an elongated horizontally disposed bar 22. The bar 22 is characterized as a cylindrical tube having along the underside thereof a key portion 24 comprising a rod or tube welded to the bar 22 and being of a diameter substantially less than the diameter of the tube comprising the bar 22. The support bar 22 is connected to a pair of spaced apart legs 26 which include at their respective upper ends, suitable clamp members 28 which are configured to slide along the rails 18 and be secured in preselected positions on the rails by respective clamp screws 30. The lower ends of the legs 26 are fixed to respective tubular sleeve clamp members 32 which are characterized as generally cylindrical tubes having a longitudinal slot formed therein to provide clearance for the key 24 and to permit clamping action by the drawing together of spaced apart depending lug portions 34, as shown in FIG. 3. The lug portions 34 are suitably biased toward each other by a clamp screw 38 in a conventional manner.

The support structure for the positioning mechanism of the present invention further includes a pair of spaced apart adjustable struts 40, one shown in FIG. 2, which are connected at one end to the clamp members 32 and at their respective opposite ends to short leg portions 42 fixed to respective ones of table clamp members 28. The short leg portions 42 include hinge meams 44 and externally threaded strut portions 46. As shown in FIG. 2, each of the struts 40 includes an externally threaded strut portion 48 having a bent end portion which is pivotally received in a tube 50 fixed to the side of the clamp member 32. The strut 40 further includes an elongated tubular strut member 52 which is threadedly engaged with the members 46 and 48. The strut members 46, 48 and 52 are cooperable in the manner of a conventional turnbuckle to be adjustable to accommodate various table widths and to provide added rigidity to the support bar 22.

As will be appreciated from the foregoing description, a mechanically uncomplicated support structure is provided as part of the positioning mechanism of the present invention, which may be readily connected to standard operating tables and the like and which is movable with the table in various positions thereof. Moreover, the support bar 22 may be longitudinally, as well as somewhat laterally adjusted with respect to the support surface of the table, and the legs 26 may be adjusted to desired positions along the sides of the table 10. Although the legs 26 are shown as fixed elongated members, those skilled in the art will appreciate that the legs 26 may also be characterized by two parts which may be adjustable longitudinally so that the position of the bar 22 may be adjusted vertically. For example, the legs 26 could be adapted to be configured similar to the struts 40 by having multi-part threaded sections for adjusting the vertical elevation of the clamp members 32 with respect to the support rails 18.

In the performance of various surgical procedures, particularly in orthopedic surgery, it is necessary to support various portions of the body including extremities, such as arms or legs, in a suspended position while the procedure is being carried out. It is also often necessary to vary the predetermined position of the extremity or other portion of the patient's body during the procedure. In this regard, the apparatus of the present invention includes one or more elongated somewhat C-shaped arms, generally designated by the numeral 54 in FIGS. 1 and 2. The arm 54 includes a lower base portion 56 comprising a tube bent at a generally right angle and having at the lower distal end thereof, a depending shaft portion 58, FIGS. 3 and 4, which is disposed within an upwardly projecting tubular support member 60. The member 60 is part of a positioning mechanism 62 which will be explained in further detail herein. The base portion 56 of the support arm is adapted to receive an upper arm portion 64 telescopingly within the base portion 56 and which may be suitably clamped thereto in a selected one of various positions and may be removed with the base portion 56 for sterilization. By providing the upper arm portion 64 as a member slidably received within the lower base portion 56, any vertical adjustment of the upper arm portion 64 will not result in movement of the arm portion below a sterile area. Moreover, the upper arm portion 64 may be easily removed with the base portion 56 for sterilization purposes.

Referring particularly to FIG. 2, the upper arm portion 64 is adapted to support a sling 66 by means of suitable hanger members 68 and 70. Those skilled in the art will appreciate that the sling 66, together with the hanger members, may take various forms other than the specific form illustrated. The sling 66 is adapted to, for example, suspend an arm or a leg of a patient, not shown, while lying on the table 10 and undergoing treatment. As indicated previously herein, during the performance of various surgical procedures and treatment, it is necessary to move a portion of the patient extremity or apply biasing forces in one direction or another. In this regard, the arm 54 together with the sling 66 is adapted to be positioned substantially universally with respect to the table 10 within a wide range of positions by either the mechanism 62 illustrated in FIGS. 1, 2, 4, 5 and 6 or by a second embodiment of a positioning mechanism, generally designated by the numeral 68, and illustrated in FIGS. 3 and 7.

Figure 4:
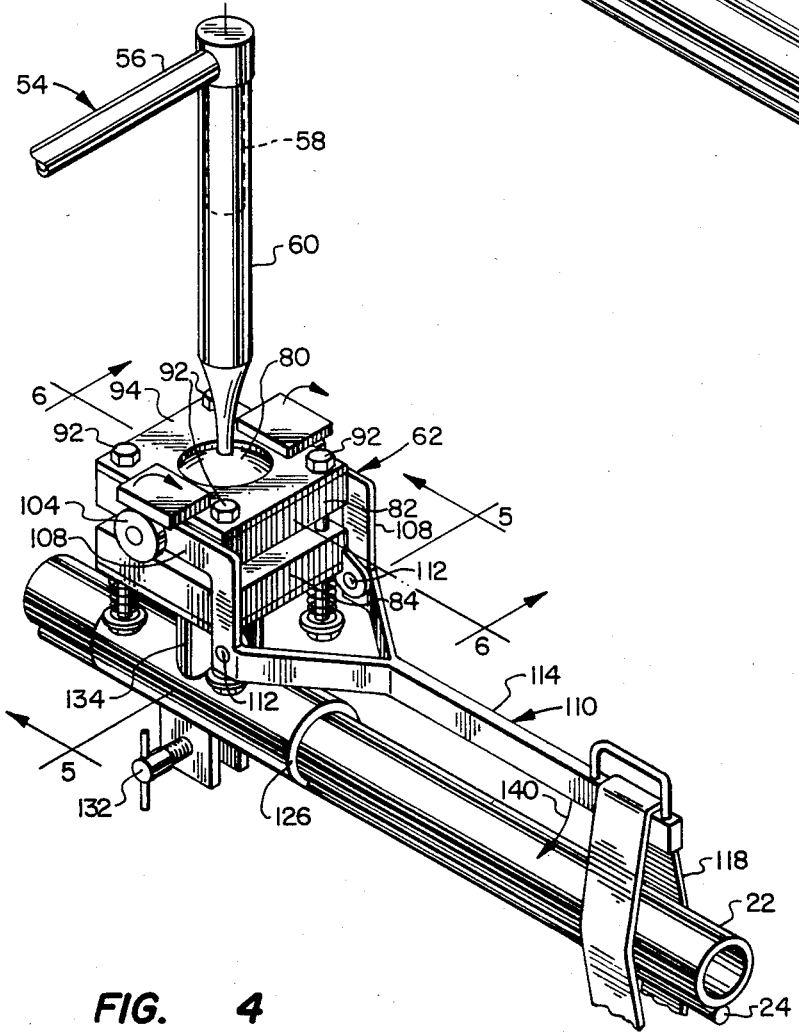
FIG. 4 is a perspective view of another embodiment of a positioning mechanism in accordance with the present invention.
Figure 5:
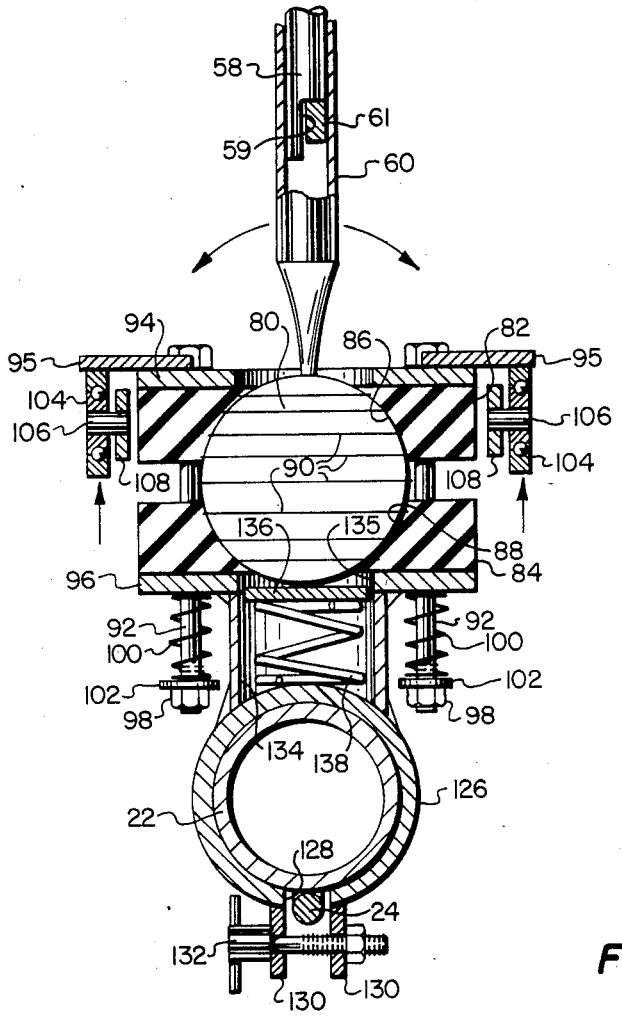
FIG. 5 is a section view taken substantially along the line 5—5 of FIG. 4.
Figure 6:
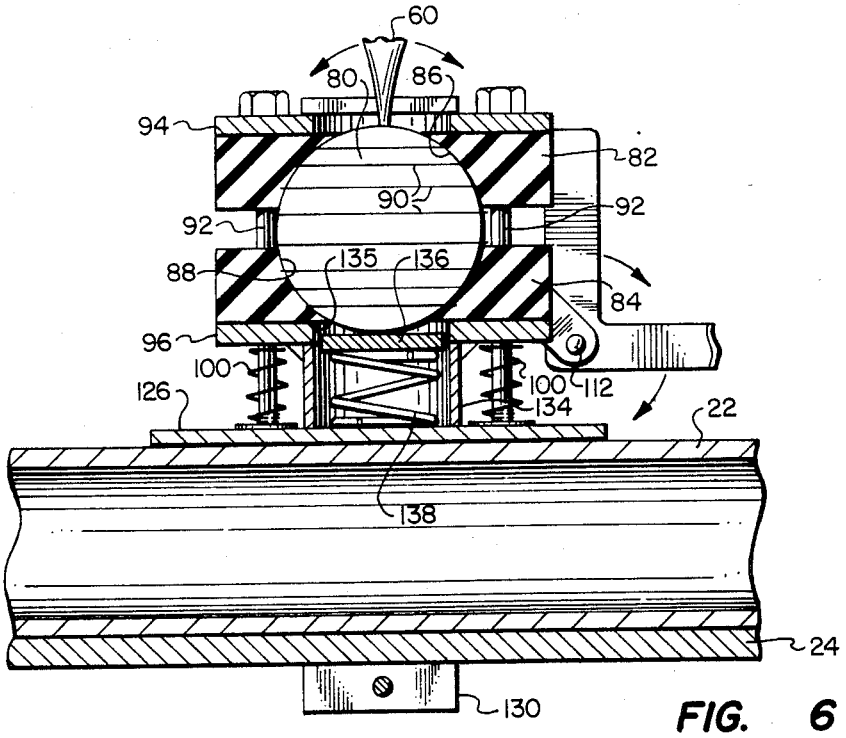
FIG. 6 is a section view taken substantially along the line 6—6 of FIG. 4.

Referring to FIGS. 4, 5 and 6, the positioning mechanism 62 for supporting the arm 54 will now be described. It will be appreciated from the description herein, that one or more of the mechanisms 62 and 68 together with connected arms 54, may be positioned along the bar 22, as required. The positioning mechanism 62 includes the upstanding support tube 60 for the arm 54 which is fixed at its lower end to a first member comprising a generally spherical ball 80. The ball 80 is disposed between a pair of spaced apart support blocks 82 and 84 which, as shown in FIGS. 5 and 6, are provided with cooperating spherical socket portions 86 and 88, respectively. The ball 80 is provided with a plurality of lateral ridges 90 extending therearound for gripping the socket portions 86 and 88 of the respective support blocks. The support blocks 82 and 84 are preferably made of an elastomeric material such as rubber of approximately 70 durometer. Moreover, the ball 80 may be formed of a suitable material such as substantially rigid polyurethane or the like.

The blocks 82 and 84 are biased toward each other by resilient means comprising a plurality of spaced apart guide pins 92 which extend through suitable holes in the blocks 82 and 84, as well as through upper and lower block support plates 94 and 96. The guide pines 92 are preferably formed as elongated hex head machine bolts and are provided with adjustable nuts 98 which engage respective coil springs 100 held between the underside of the support plate 96 and suitable washers 102 disposed around the guide pins and retained thereon by the nuts 98. Accordingly, the biasing force urging the blocks 82 and 84 toward each other may be adjusted by positioning the nuts 98 on the respective guide pins to vary the deflection of the coil springs 100.

The upper support plate 94 is provided with laterally projecting cam follower portions 95 which are engageable with means forming spaced apart roller cams 104, as shown in FIG. 5. The cams 104 are rotatably supported on trunnions 106 which are fixed to spaced apart arm portions 108 of a lever, generally designated by the numeral 110. The lever 110 is pivotally mounted on the lower support plate 96 by means of suitable pivot members 112 as shown in FIGS. 4 and 6. The lever 110 includes a lever arm portion 114 extending generally horizontally above the bar 22 and connected at its distal end to a flexible belt loop 118 disposed around the bar 22 and connected at its lower end to a food pedal 120, as shown in FIGS. 1 and 2. The pedal 120 may include a suitable support bracket 122, as shown in FIG. 2, so that the pedal may be mounted on the floor 13 or, the pedal 120 may be merely suspended from the belt 118.

Referring further to FIGS. 5 and 6, the positioning mechanism 62 further includes a cylindrical tubular clamp member 126 which is adapted to support the positioning mechanism on the bar 22 in a preselected position therealong. The tubular clamp member 126 includes a longitudinal slot 128 formed therein adjacent which depending lug portions 130 are provided and are cooperable with a clamp screw and nut assembly 132 for releasably clamping the member 126 in a preselected position along the bar 22. The clamp member 126 includes a vertically upwardly extending tubular support bracket portion 134 which is fixed to the support plate 96. Disposed within the tubular support bracket 134 is a disc member 136 which is mounted above a coil spring 138 and is engageable with the lower side of the ball 80. Both of the blocks 82 and 84 are formed such that the socket portions 86 and 88 intersect the respective top and bottom surfaces of the blocks so that the ball projects therethrough. The blocks 82 and 84 may, in fact, be identical in construction. Accordingly, the support plate 96 is provided with a cylindrical opening 135 so that the disc member 136 is engageable with the surface of the ball 80. The coil spring 138 yieldably biases the ball upwardly out of the socket portion 88 but this biasing force is substantially counteracted by the biasing force of the springs 100 which urge the support blocks 82 and 84 to clamp the ball 80 in a fixed preselected position.

As will be appreciated from the foregoing, the positioning mechanism 62 may be operated to allow the ball 80, and the arm 54 connected thereto, to be universally positioned in a predetermined attitude by urging the supporting blocks 82 and 84 away from each other sufficiently to allow the ball 80 to be rotated with respect to the blocks. Accordingly, by movement of the lever arm 114 downwardly, in the direction of the arrow 140 in FIG. 4, the cams 104 are rotated into forcible engagement which the cam follower portions 95 to move the support plate 94 and the guide pins 92 upwardly to relieve the clamping force acting on the support block 82 whereby the ball 80 may be rotated at will or allowed to rotate under a biasing force imposed thereon by the arm 54. Upon reduction of the clamping force provided by the springs 100 and guide pins 92, the disc member 136 is operable to assist in unseating the ball 80 from the socket portion 88 to facilitate rotation thereof. This action is found to be advantageous due to the ridges 90 formed on the ball which operate to assist in retaining the ball in its predetermined position.

Therefore, the positioning mechanism 62 may be operated at will by a surgeon or support personnel to allow the ball 80 and the arm supported thereby to be adjusted in position or with respect to a biasing force imposed on a patient during the performance of a surgical procedure or the like. Moreover, the positioning mechanism 62 enables operating personnel to control the position of the arm 54 without touching the arm or the mechanism with the hands during surgery or the like and thereby avoiding contamination of the hands. Furthermore, during some particularly delicate procedures, the mechanism 62 allows the surgeon to provide very fine adjustment of the position of the arm 54 or a biasing force imposed on the patient by the arm.

The clamp screw 132 may be suitably adjusted so that the entire positioning mechanism 62 may be slid along the bar 22 when a suitable force is applied to the mechanism or to the arm 54 as desired. Since the ball 80 may be rotated about the axis of the support tube 60 as well as axes which are mutually perpendicular to the longitudinal axes of the support tube, the depending rod portion 58 need not be rotatable within the support tube. In this regard, the distal end of the rod portion 58 is provided with a notch 59, FIG. 5, which is cooperable with a suitable key 61 fixed within the support tube 60 to prevent rotation of the support rod with respect to the tube.

Figure 7:
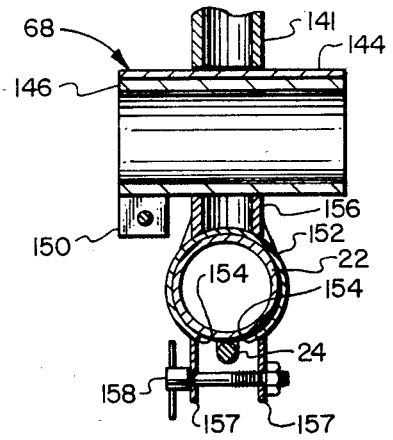
FIG. 7 is a detail section view taken substantially along the line 7—7 of FIG. 3.

Referring to FIGS. 3 and 7, the positioning mechanism 68 includes an upwardly extending cylindrical support tube portion 141 in which may be disposed the rod portions 58 of an arm 54. The support tube portion 141 is provided with a clamp screw 142 for clamping the arm 54 in a predetermined rotative position with respect to the longitudinal central axis 143 of the support tube 141. The support tube 141 is affixed to a cylindrical sleeve clamp member 144 having a longitudinal central axis 145 perpendicular to the longitudinal central axis of the support tube 140. The sleeve member 144 is coaxially disposed on a cylindrical mounting bracket member 146 and is rotatably adjustable thereon by means of a clamp screw 148 interconnected between depending lug portions 150 to provide a clamping arrangement similar to the clamping arrangement for the support sleeve 126 illustrated in FIG. 5.

The positioning mechanism 68 further includes a support sleeve 152 disposed on the bar 22 and extending circumferentially therearound to be delimited by edge portions 154. The support sleeve 152 includes an upstanding bracket portion 156 which is fixed to the cylindrical support member 146. The sleeve 144 is suitably cut away from the bottom portion thereof to provide for rotation of this sleeve with respect to the member 146 over a suitable arc on either side of the vertical position shown to give suitable range to positioning of the arm 54. Moreover, the sleeve 152 may be rotated about the central axis 21 of the bar 22 to the limit positions by the edges 154 as they engage the key 24, respectively. The support sleeve 152 is constructed similar to the sleeve 126 and has depending lug portions 157 and a clamping screw 158. It will be understood from the foregoing description that the positioning mechanism 68 provides for movement of the arm 54 about three mutually perpendicular axes to thereby provide substantial universal movement of the arm. Moreover, the clamping forces provided by the clamp screws 142, 148 and 158 may be varied to permit movement of the arm 54 under a suitable urging force but to otherwise retain the arm in a predetermined position.

Those skilled in the art will appreciate that any combination of the positioning mechanisms 62 and 68 may be used in predetermined spaced relationship with respect to each other along the bar 22 for positioning respective ones of the support arms 54 to support a patient lying on the table 10. Normally, for positioning a patient extremity or a portion thereof, which position is not likely to be changed during a procedure, the positioning mechanism 68 will be used and preset in a fixed position. For positioning an extremity which is likely to undergo a position change or have a change in biasing force acting thereon during treatment, it is preferred to use the mechanism 62 which can be finely adjusted to change the position of the arm 54 connected thereto.

Those skilled in the art will also appreciate that the overall arrangement of the positioning apparatus of the present invention is particularly advantageous for use in connection with surgical and other medical procedures. Although preferred embodiments of the present invention have been disclosed in detail herein, it will be understood that various substitutions and modifications may be made to the preferred embodiments without departing from the scope and spirit of the present invention as recited in the appended claims.

What I claim is:

1. Positioning apparatus for positioning a patient extremity in a predetermined positioning during a medical procedure, said positioning apparatus comprising:

(a) mechanism connected to an elongated support arm and supported by support means connected to an operating table or the like, said mechanism including (1) a first member comprising a generally spherical ball, (2) a second member comprising a pair of opposed blocks forming spherical socket portions for journalling said ball, (3) means for yieldably biasing said blocks toward each other for forceable engagement with said ball to retain said blocks and said ball in a predetermined position with respect to each other, said first and second members forming a coupling between said arm and said support means, and (4) release means for releasing said blocks and said ball from said forceable engagement, and said release means comprising means for moving one of said blocks relative to the other of said blocks to reduce the biasing force acting on said ball;

(b) support means connecting said mechanism to an operating table or the like comprising a bracket supporting one of said blocks, the other of said blocks being connected to said one block by a plurality of elongate guide pins;

(c) spring means interposed between said one block and a portion of each of said pins for biasing said blocks toward each other; and (d) a lever pivotally mounted on said bracket and operable to release said biasing force of said spring means so that the position of said ball and said arm may be selectively varied.

2. The apparatus set forth in claim 1 wherein:

said lever includes a first portion engageable with a support plate interposed between said other block and head portions on said guide pins for moving said guide pins to reduce the biasing force on said other block, and said lever includes a second portion having actuating means operably connected thereto.

3. Positioning apparatus for positioning a patient extremity in a predetermined position during a medical procedure, said positioning apparatus comprising:

(a) mechanism connected to an elongated support arm and supported by support means connected to an operating table or the like, said mechanism including (1) a first member comprising a generally spherical ball, (2) a second member comprising a pair of opposed blocks forming spherical socket portions for journalling said ball, (3) means for yieldably biasing said blocks toward each other for forceable engagement with said ball to retain said blocks and said ball in a predetermined position with respect to each other, and (4) release means for releasing said blocks and ball from said forceable engagement, said release means comprising means for moving one of said blocks relative to the other of said blocks to reduce the biasing force acting on said ball;

(b) said support arm including a base portion connected to said ball, said base portion having a generally vertically extending tubular part, and a second part of said arm telescopingly insertable in said tubular part of said base portion, said second part extending generally above a patient support surface on said table.

4. Positioning apparatus for positioning a patient extremity in a predetermined position during a medical procedure, said positioning apparatus comprising:

(a) mechanism connected to an elongate support arm and supported by support means connected to an operating table or the like, said mechanism including
(1) a first member comprising a generally spherical ball,
(2) a second member comprising a pair of opposed housings forming generally circular jaws for journaling said ball,
(3) means for yieldably biasing said housings toward each other for forceable engagement with said ball to retain said housings and said ball in a predetermined position with respect to each other, said first and second members forming a coupling between said arm and said support means, and
(4) releasing means for releasing said forceable engagement, said releasing means comprising means for moving one of said housings relative to the other of said housings to reduce the biasing force acting on said ball;
(b) support means connecting said mechanism to an operating table or the like comprising a bracket supporting one of said housings, the other of said housings being connected to said one housing by a plurality of elongate guide pins;
(c) spring means interposed between said one housing and a portion of each of said pins for biasing said housings toward each other; and
(d) a lever pivotally mounted on said one housing and operable to release said biasing force of said spring means so that the position of said ball and said arm may be selectively varied.

5. Positioning apparatus for positioning a patient extremity in a predetermined position during a medical procedure, said positioning apparatus comprising:
(a) mechanism connected to an elongate support arm and and supported by support means connected to an operating table or the like, said mechanism including
(1) a first member comprising a generally spherical ball,
(2) a second member comprising a pair of opposed housings forming generally circular jaws for journaling said ball,
(3) means for yieldably biasing said housings toward each other for forceable engagement with said ball to retain said housings and said ball in a predetermined position with respect to each other, and
(4) releasing means for releasing said forceable engagement, said releasing means comprising means for moving one of said housings relative to the other of said housings to reduce the biasing force acting on said ball;
(b) said support arm including a base portion connected to said ball, said base portion having a generally vertically extending tubular part, and a second part of said arm telescopingly insertable in said tubular part of said base portion, said second part extending generally above a patient support surface on said table.

6. Positioning apparatus for providing a predetermined position of a patient extremity relative to the patient support surface of an operating table, said positioning apparatus comprising:
an elongate bar mounted to said table generally below and laterally offset with respect to the patient support surface of said table;
an upright support arm extending above the patient support surface of said table;
universal connecting means including first and second connecting members mounted with said elongate bar for universal positioning of said support arm relative to said bar, said universal connecting means including a movable interconnecting member attached to said support arm and disposed for releasable coupling engagement with said first and second connecting members, said connecting means operable to position said arm with a range determined substantially by limit positions of said connecting means;
first resilient biasing means coupled to said universal connecting means for biasing said first and second connecting members into forceable engagement with said interconnecting member for retaining said support arm in a predetermined position relative to said bar;
bias releasing means mounted with said universal connecting means for selectively releasing said forceable engagement of said first and second connecting members sufficiently to permit movement of said support arm relative to said bar; and,
said moveable interconnecting member being a generally spherical ball and wherein said first and second connecting members each include a housing and an annular jaw member carried by said housing for engaging said ball on opposite sides thereof to retain said support arm in a desired position relative to said patient support surface.

7. The apparatus as set forth in claim 6, wherein one annular jaw member is rigidly mounted onto its respective housing, and wherein the other jaw member is movably mounted with its respective housing in a manner to be adjustable relative to said rigidly mounted jaw member to permit alignment of itself relative to said rigidly mounted jaw member about said ball.

8. The apparatus as set forth in claim 7, wherein said pair of opposed housings are attached together in a manner to essentially close together about said ball, and wherein one of said housings includes an open passageway therein for receiving said support arm therethrough.

9. The apparatus as set forth in claim 8, wherein said resilient biasing means is mounted with said first connecting member for urging said pair of opposed housings toward each other to enable said jaws to engage said ball.

10. The apparatus as set forth in claim 9, wherein said biasing releasing means comprises means for separating said pair of opposed housings sufficiently to disengage said jaws from said ball to permit movement of said ball relative to said jaws.

11. The apparatus as set forth in claim 10, wherein said attachment device comprises an elongate member and said first connecting member includes a sleeve concentrically slideably mounted on said elongate member, said sleeve including means for releasably clamping said sleeve to said elongate member.

12. The positioning apparatus as set forth in claim 6, including
second resilient biasing means coupled to said movable interconnecting member for moving said spherical ball and unseating it with respect to at least one annular jaw member in response to release of forceable engagement of said first and second connecting members.

13. The positioning apparatus as set forth in claim 6, wherein said spherical ball is provided with a ridge projection for establishing line contact engagement against at least one jaw member.

* * * * *